United States Patent [19]

Persson

[11] 4,385,930

[45] May 31, 1983

[54] METHOD OF PRODUCING ALUMINUM

[75] Inventor: John A. Persson, Gibsonia, Pa.

[73] Assignees: Reynolds Metals Co., Richmond, Va.

[21] Appl. No.: 230,629

[22] Filed: Feb. 2, 1981

[51] Int. Cl.[3] ..... C22B 21/02

[52] U.S. Cl. ..... 75/10 R; 75/68 A

[58] Field of Search ..... 75/10 R, 68 RA

[56] References Cited

U.S. PATENT DOCUMENTS 4,216,010 9/1980 Kibby ..... 75/10 R 4,224,054 9/1980 Southam ..... 75/68 A

*Primary Examiner*—M. J. Andrews

*Attorney, Agent, or Firm*—Alan T. McDonald; Alan T. McDonald

[57] ABSTRACT

A method of producing aluminum is carried out in an electric arc furnace having primary and secondary zones separated by a divider constructed to permit the flow of molten but not gaseous products between zones. The method includes providing a charge of carbon into the primary zone containing a mixture of aluminum and aluminum carbide and providing a charge of alumina to the secondary zone, simultaneously heating the zones to react said carbon with the aluminum to form aluminum carbide in said mixture, flowing the mixture into the secondary zone, reacting the aluminum carbide in the mixture with alumina to form additional aluminum and an aluminum oxycarbide slag, flowing the slag to the primary zone for reaction with the aluminum carbide to form aluminum in the mixture, and tapping aluminum from the secondary zone.

9 Claims, 1 Drawing Figure

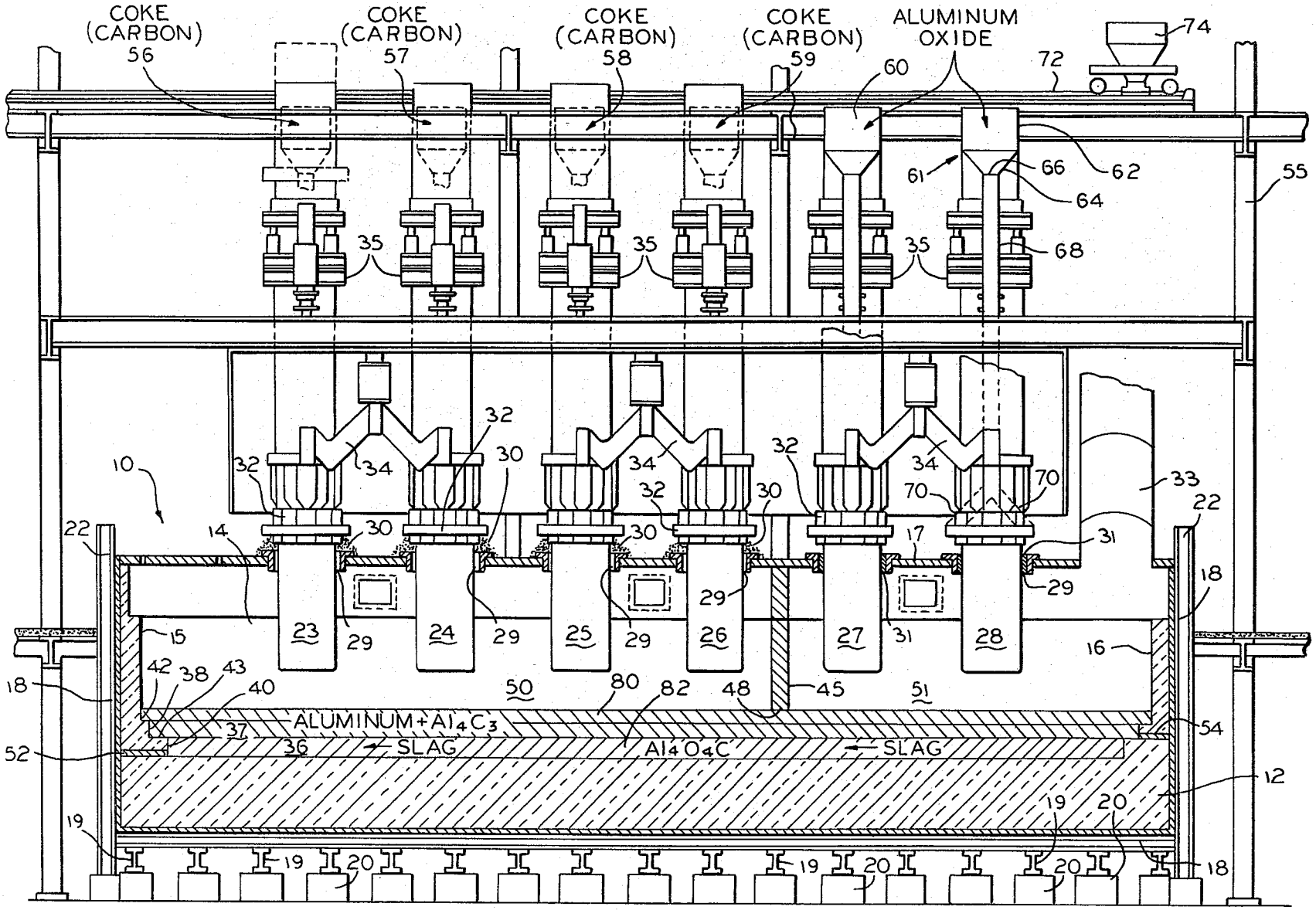
ALUMINUM OXIDE
COKE (CARBON) 56
COKE (CARBON) 57
COKE (CARBON) 58
COKE (CARBON) 59
SLAG
$Al_4O_4C$
ALUMINUM + $Al_4C_3$
SLAG

METHOD OF PRODUCING ALUMINUM

FIELD OF THE INVENTION

This invention relates generally to the art of smelting and more particularly to a method for producing aluminum.

BACKGROUND OF THE INVENTION

In the production of aluminum, various methods are employed which utilize electric arc furnaces. In one prior art method, a first furnace is charged with carbon in the form of coke along with aluminum oxycarbide slag. The furnace is heated to a temperature of about 2000° C. resulting in the formation of aluminum carbide along with some aluminum and slag. The aluminum carbide is charged into the second furnace either in the molten state or it is first permitted to cool after which it is crushed to a suitable size prior to charging. In the second furnace, the aluminum carbide is reacted with alumina to form aluminum which is recovered and slag which is returned to the first furnace.

Since the temperature required for the reduction of aluminum is relatively high, usually about 2000° C., and since the heat transfer rate between bodies of disparate temperature is directly related to the temperature differences between the two bodies, it is advantageous from an energy conservation standpoint to retain any material being transported from a first reduction stage to a second stage in a high temperature ambient. In smelting processes using separate furnaces, considerable heat is lost, requiring the addition of this lost energy in the second furnace. This is true regardless of whether intermediate products are delivered to the second furnace in a molten or in a solid, crushed state. In addition, exposure of intermediate products to ambient air often results in undesirable chemical reactions.

Prior art smelting processes employing two or three furnaces also have substantial manpower requirements. Because of the additional energy, equipment and manpower required, prior art processes are normally accompanied by unnecessarily high costs. Further, prior art methods result in a degree of physical loss of intermediate or final product due to repeated handling.

A method of producing aluminum in a single vessel which overcomes the aforementioned disadvantages of the prior art would be a significant advance in this technology.

OBJECTS OF THE INVENTION

It is a primary object of the present invention to provide a new and improved method of producing aluminum in a single vessel.

Another object of the present invention is to provide a method for producing aluminum which avoids contact and reaction of the intermediate products with ambient air.

Yet another object of the present invention is to provide a method for producing aluminum which avoids the need for cooling, crushing and transporting intermediate products between furnaces.

A further object of the present invention is to provide a method for producing aluminum which avoids the physical loss of intermediate products resulting from tapping and ladle handling between furnaces.

A still further object of the present invention is to provide a method for producing aluminum which results in significant savings in manpower, equipment and energy.

How these and other objects of the invention are accomplished will be described in the following specification taken in conjunction with the drawing. Generally, however, the objects are accomplished by utilizing an electric arc furnace having primary and secondary zones divided by a barrier which permit the flow of molten but not gaseous products between zones. In accordance with the preferred embodiment of the present invention, a charge of carbon is reacted with an aluminum-aluminum carbide mixture contained in the primary zone to form additional aluminum carbide in the mixture which flowed into a secondary zone. Alumina is charged into the secondary zone to form aluminum which is recovered and aluminum oxycarbide slag which is flowed to the primary zones for reaction with aluminum carbide to form additional aluminum in the mixture.

Other features of the present invention which aid in satisfying the above-noted objects will be described in the following detailed description of the preferred embodiment.

DESCRIPTION OF THE DRAWING

The single FIGURE of the drawing is a side elevation view with a portion broken away, of a direction reduction electric arc furnace employed in carrying out the process of the present invention.

DESCRIPTION OF THE PREFERRED EMBODIMENT

The drawing shows an electric arc furnace 10 in which the method according to the invention may be carried out. The furnace 10 may be generally rectangular in plan view and includes a generally planar refractory hearth 12, generally vertical refractory walls which include a front wall (not shown), a rear wall 14, side walls 15 and 16, and a refractory roof 17. A metallic shell 18 may be disposed beneath hearth 12 and around the walls 14, 15 and 16. In addition, the hearth may be mounted on a suitable support consisting of longitudinally and transversely extending I-beams 19 disposed on footings 20. Lateral support for the walls 14–16 may be provided by vertically extending I-beam members 22.

A plurality of electrodes 23, 24, 25, 26, 27 and 28 extend vertically through spaced apart openings 29 in roof 17 and while self-baked electrodes are illustrated, it will be understood that pre-baked carbon electrodes may also be employed. The annular openings 29 surrounding electrodes 23, 24, 25 and 26 permit the feeding of reductant coke into a primary zone furnace 50 and have a dimension selected to enable a burden of coke to partially seal openings 30 at all times. In this manner, the coke 30 will entrap valuable constituents in the furnace gaseous effluents. The annular openings 29 surrounding electrodes 27 and 28 in a secondary furnace zone 52 are closed with gas tight seals 31. Electrical energy is supplied to each of the electrodes by a suitable arrangement of contact plates 32 which engages its respective electrode above the furnace roof. The contact plates associated with each pair of electrodes are connected by suitable conductors 34 to a source of electrical energy such as a single phase alternating current transformer (not shown). Conventional electrode slipping mechanisms 35 engage each of the electrodes 23–28 for supporting and feeding the same into the furnace 10 as the lower ends are consumed. For a more complete description of such a slipping mechanism, reference is made to U.S. Pat. No. 4,154,974. An exhaust stack 33 may connect the furnace 10 to a suitable gas cleaning system (not shown) for withdrawing and treating gaseous combustion products of the smelting operation.

The intersections of the hearth 12 and walls 14, 15 and 16 are defined by step-like formations consisting of vertical risers 38 and 40 and horizontal surfaces 42 and 43. Hearth 12 is thereby divided into horizontally disposed first basin 36 and second basin 37 thereabove. Extending downward from roof 17 of the furnace is a planar barrier 45 positioned between the electrodes 26 and 27. Barrier 45 extends between the front and rear walls and downwardly from the roof to an elevation where its lower edge 48 contacts the molten bath when the furnace is in operation. The furnace is thereby partitioned into primary zone 50 and secondary zone 51. The portion of hearth 12 underlying primary zone 50 is lined with carbon refractory brick while the portion underlying secondary zone 51 is lined with aluminum oxide refractory.

A first tap hole 52 extends through the end wall 15 to communicate with the first basin 36 at about the intersection of the riser 40 and hearth 12, and a second tap hole 53 extends through the wall 16 to communicate with second basin 37 at about the intersection of riser 38 and surface 43. Those skilled in the art will appreciate that a removable plug of refractory material is disposed in each tap hole during operation and that a spout (not shown) is provided at the outlet end of each for directing molten material into a suitable ladle or the like.

A framework 55 is disposed adjacent the furnace 10 and extends upwardly along the sides thereof for supporting the slipping machanism 35 and a plurality of hoppers 56, 57, 58, 59, 60 and 61 above the furnace roof 17 and on the opposite sides of respective electrodes 23, 24, 25, 26, 27 and 28. Each hopper includes a storage bin 62 having a lower end 64 which is generally funnel shaped and has a central opening 66. A vertically extending discharge conduit 68 is coupled at its upper end to the central opening 66 and its lower end to a pair of feed pipes 70 which extend into roof ports adjacent to and on opposite sides of its respective electrode.

The framework 55 also supports two pairs of rails 72, one pair of which is disposed above each row of hoppers 56–61. One or more hopper cars 74 may be disposed on each pair of rails for being selectively positioned above the respective hoppers and for discharging the required furnace charge into each. It can be seen that hoppers 56, 57, 58 and 59 are positioned to feed charges into the primary zone 50 while hoppers 60 and 61 are positioned to feed charge into the secondary zone 51. A valve or gate will be disposed in each of the hopper openings 66 so that the charge material can be fed into the furnace selectively.

During start-up, a charge of aluminum carbide or carbon in the form of coke and aluminum are delivered to the furnace primary zone 50 from hoppers 56, 57, 60 and 61. The electrodes 23–26 are energized whereby the aluminum carbide is melted or the aluminum and carbon charge reacts to form a pool of aluminum carbide. In either case, the mixture of aluminum carbide ($Al_4C_3$) flows into both zones. Alumina ($Al_2O_3$) is then charged into the secondary zone 51 in a ratio ranging from about 0.8 to 0.97 by weight of alumina to aluminum carbide. Simultaneously, coke is charged into the primary zone 50. In addition, the electrodes 27 and 28 will be energized to provide the required heat of fusion. The alumina reacts with the aluminum carbide to from aluminum containing about 2% aluminum carbide and an aluminum oxycarbide slag ($Al_4O_4C$). The process may then continue with carbon being charged into the primary zone 50 and alumina into the secondary zone 51.

In the primary zone 50, a layer containing a mixture of aluminum and aluminum carbide 80 will be formed. The carbon being charged into the zone will react with the aluminum in the mixture to form aluminum carbide. The mixture 80 will be about 90% aluminum and 10% aluminum carbide. The layer 80 is free to flow beneath partition 45 into the secondary zone 51. There, the alumina and aluminum carbide react at temperatures of about 2050° C. to form aluminum containing about 2% aluminum carbide and aluminum oxycarbide slag, which being heavier than the aluminum, forms a bottom layer 82. The slag layer 82 flows countercurrent to the layer 80 and from the secondary zone 51 to the primary zone 50. In the primary zone, the slag reacts with the aluminum carbide in the layer 80 to provide aluminum metal containing about 2% aluminum carbide. However, the simultaneous addition of carbon charged into the first zone reacts with the aluminum to elevate the percentage of aluminum carbide in the layer 80 to 10% as indicated above. The rate of carbon charge is regulated so that the layer 80 will be in an equilibrium state with the addition of carbon balancing that removed by the interaction of the slag with the aluminum carbide.

It can be seen in the drawing that the coke is added through ports 30 and thus also acts as a filter for trapping aluminum and aluminum oxide vapors entrained in the gaseous stream (primarily CO) as it exits the vessel. The effluent gases are then collected and suitably cleaned.

Molten aluminum containing less than 2 weight percent of aluminum carbide impurity is withdrawn through tap hole 53 periodically each six to eight hours. Some slag may be periodically tapped from that portion of first basin 36 within secondary zone 52 to maintain impurities at an acceptable level.

The following example will illustrate the best mode contemplated for carrying out the novel process of this invention.

EXAMPLE 1

Coke is charged into the primary zone containing a top layer of aluminum and about 10% aluminum carbide over a layer of aluminum tetra-oxycarbide slag at a temperature of about 2050° C. Simultaneous reactions between the carbon and aluminum on the one hand and the slag with the aluminum carbide on the other maintain the top layer composition at about 10% aluminum carbide and 90% aluminum by weight. The top layer of aluminum and aluminum carbide flows beneath the divider 45 into the secondary zone which is charged with alumina ($Al_2O_3$) and is maintained at about 2050° C. A reaction between the alumina and the aluminum carbide in layer 80 produces aluminum containing about 2% aluminum carbide and the aluminum oxycarbide slag 82. Periodically, the aluminum is tapped from the secondary zone through tap 54.

EXAMPLE 2

The process of Example 1 is repeated with the exception that, subsequent to the initial reduction of the charge in the secondary zone, a quantity of calcium oxide is bled into the secondary zone for fluxing purposes.

While only a preferred embodiment of the invention has been illustrated and described, it is not intended to be limited thereby but only by the scope of the appended claims.

I claim:

1. A method of producing aluminum in an electric arc furnace having primary and secondary zones separated by means constructed and arranged to permit the flow of molten but not gaseous products between zones, said primary zone containing aluminum oxycarbide slag and said second zone aluminum carbide, comprising the steps of:

providing a charge of carbon into said primary zone, providing a charge of alumina into said secondary zone, simultaneously melting said charges to form a molten mixture of aluminum and aluminum carbide in said primary zone and aluminum tetraoxycarbide slag and aluminum in said secondary zone, flowing said slag from said secondary zone into said primary zone to react with the aluminum carbide therein to form aluminum, flowing the molten aluminum and aluminum carbide mixture to said secondary zone for reaction with the alumina therein to form aluminum, and tapping aluminum from said secondary zone, all while preventing the passage from one of said zones to the other of said zones of gaseous products generated in the primary and secondary zones.

2. The method of claim 1 wherein said mixture of aluminum and aluminum carbide flowing to said secondary zone is in a ratio of about 90 weight percent aluminum to about 10 percent aluminum carbide.

3. The method of claim 2 wherein the ratio of alumina charged into said secondary zone to aluminum carbide therein is in the range of about 0.8 to 0.97 by weight.

4. The method of claims 1, 2 or 3 wherein the carbon is charged into said primary zone at a rate to maintain the ratio of aluminum carbide to aluminum at about 1:9.

5. The method of claim 4 wherein said aluminum carbide slag contains essentially aluminum tetra-oxycarbide.

6. The method of claim 5 wherein said aluminum tapped from said secondary zone includes less than 2 weight percent aluminum carbide.

7. A method of producing aluminum in an electric arc furnace having a pair of zones separated by means constructed and arranged to permit the flow of molten but not gaseous product between zones and a plurality of electrodes extending into each zone, comprising the steps of:

providing a charge of carbon mixture into a first zone containing stratified layers of aluminum-aluminum carbide and aluminum oxycarbide slag, providing a charge of alumina into a second zone containing aluminum carbide, simultaneously melting said charges to form a molten first reduction product in said first zone consisting of aluminum and aluminum carbide and a second reaction product in said second zone consisting of aluminum with a layer of molten slag therebelow, flowing said slag from said second zone into said first zone, flowing to said second zone said mixture formed in said first zone, and tapping said molten aluminum product from said second zone, all while preventing the passage from one of said zones to the other of said zones of gaseous products generated in the primary and secondary zones.

8. The method of claim 7 wherein said first mixture product includes about 10 weight percent aluminum carbide and 90 percent aluminum, the ratio of said alumina to said aluminum carbide in said second zone being in the range of 0.18 to 0.97 by weight, said slag consists essentially of aluminum tetraoxycarbide, and, said second molten product includes aluminum and a small amount of aluminum carbide.

9. The method set forth in claim 8 wherein said furnace has a pair of spaced apart primary zones separated by a secondary zone and a plurality of electrodes in each of said zones and constructed and arranged to permit the flow of molten but not gaseous products between zones comprising the steps of:

providing a charge of carbon into each of said primary zones, providing a charge of alumina into said secondary zone, and said electrodes are energized to simultaneously melt said charges at a temperature of about 2050° C.

* * * * *